United States Patent [19]

Marchetti

[11] Patent Number: 4,585,504

[45] Date of Patent: Apr. 29, 1986

[54] SELF-SIZING TAPING MACHINE FOR CARTONS

[76] Inventor: Augusto Marchetti, Piazza Sicilia, 7, 20146 Milano, Italy

[21] Appl. No.: 694,149

[22] Filed: Jan. 23, 1985

[30] Foreign Application Priority Data

Jan. 26, 1984 [IT] Italy ..... 19325 A/84

[51] Int. Cl.[4] ..... G05G 15/00

[52] U.S. Cl. ..... 156/351; 53/137; 156/360; 156/468; 156/486

[58] Field of Search ..... 156/468, 486, 475, 350, 156/360; 198/627, 628; 53/137, 374, 75

[56] References Cited

U.S. PATENT DOCUMENTS 3,623,293 11/1971 Boulay ..... 53/374

3,714,757 2/1973 Feigel et al. ..... 53/374 X 4,044,527 8/1977 Ulrich et al. ..... 53/137

4,060,442 11/1977 Marchetti ..... 156/468 X

FOREIGN PATENT DOCUMENTS 1482734 3/1971 United Kingdom .

2092988A 12/1979 United Kingdom .

2115377A 6/1982 United Kingdom .

*Primary Examiner*—David Simmons

*Attorney, Agent, or Firm*—Cushman, Darby & Cushman

[57] ABSTRACT

The machine comprises a support and advancement base for the cartons, a pair of mutually approachable conveying units and a vertically movable upper taping head. The movements of the taping head and of the conveying units are controlled by sensing members inserted in said support base.

3 Claims, 6 Drawing Figures

Fig.4
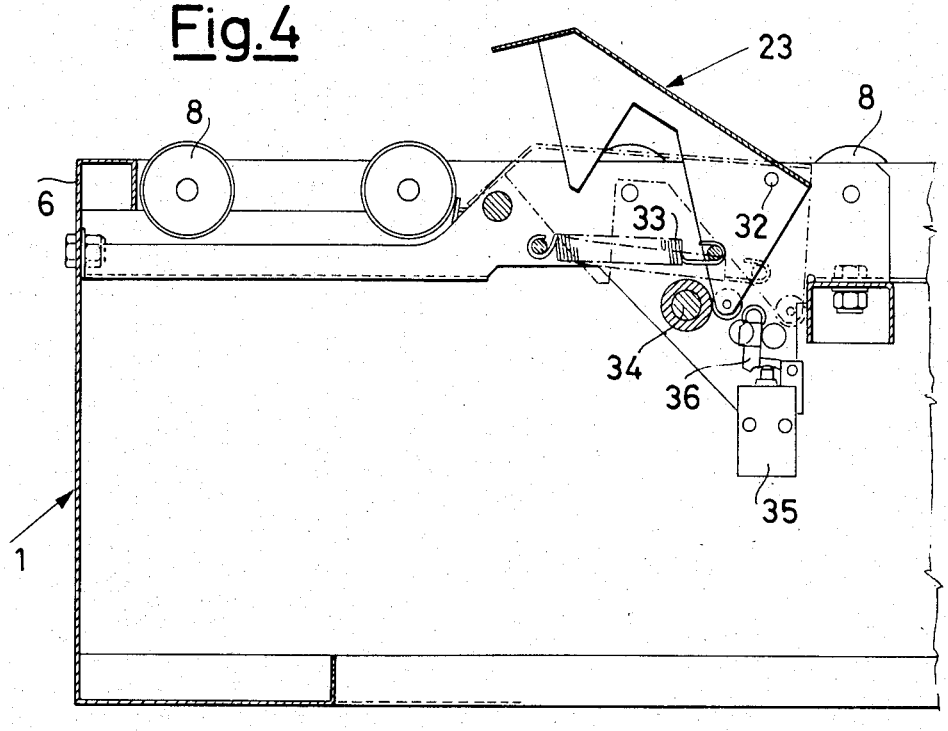
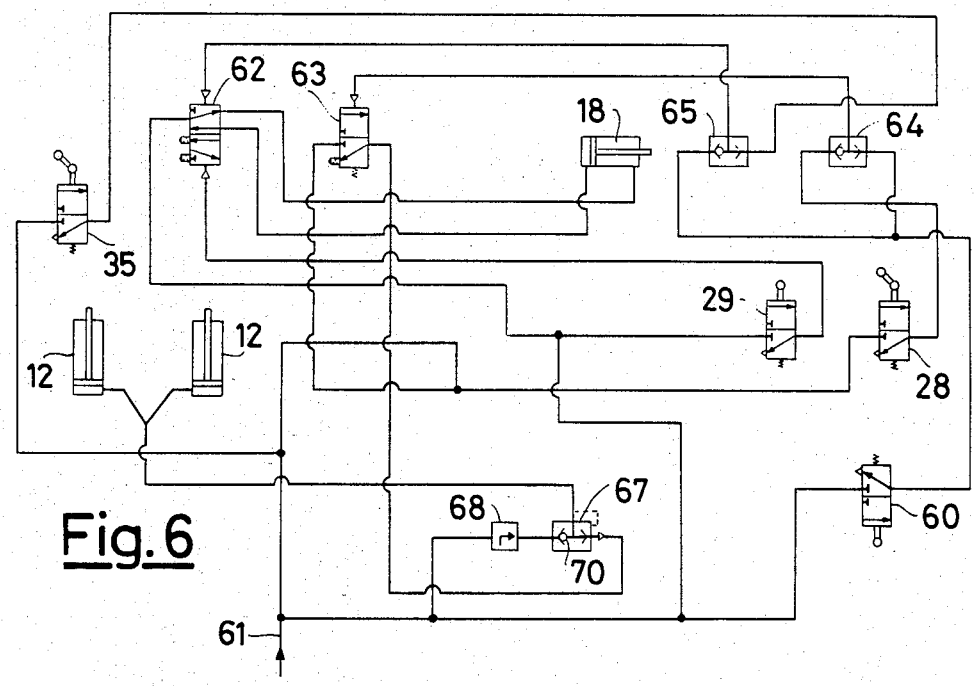
Fig.6

SELF-SIZING TAPING MACHINE FOR CARTONS

The present invention relates to a self-sizing taping machine for cartons.

"Self-sizing" are called those taping machines, which are able to receive and to tape cartons of variable size.

There are known therebetween machines comprising a support and advancement base for the cartons, a pair of conveying units with driven belts extending along opposite sides of said base and approachable to each other for a conveying engagement with the carton sides, an upper taping head superimposed to said base in vertically liftable way for the introduction of the cartons to be taped and, usually, a lower taping head included in said support base.

In the conventional machines of that type the control of the movements of the conveying units and of the upper taping head is generally entrusted to sensing members of pneumatic type, which are mounted on the upper taping head and are therefore vertically movable therewith. This makes it necessary to provide for more or less complicated pneumatic connecting systems between the movable head, where the sensing members are arranged, and the machine base, where, on the contrary, the power members are arranged.

According to the Italian patent application No. 19710 A/81 of Feb. 13, 1981, in a machine in which the only movable part is formed by the upper taping head, which bears the carton conveying belts too, it has already been proposed to arrange the sensing member for the control of the movement of the upper taping head no longer on the movable head but on the stationary support base. In such way, the machine has resulted simpler and more functional.

In view thereof, object of the present invention is to realize a self-sizing taping machine, of the type with mutually approachable lateral conveying units, in which not only the movement of the upper taping head but also that of the conveying units are controlled by sensing members inserted in the support plane of the machine.

According to the invention, such an object has been reached by a self-sizing taping machine, comprising a support and advancement base for the cartons, a pair of conveying units with driven belts extending along opposite sides of said base and approachable to each other for a conveying engagement with the carton sides, an upper taping head superimposed to said base in vertically movable way for the introduction of the cartons to be taped and sensing members able to control the movement of said upper taping head and of said conveying units according to the position of the cartons along an advancement path from one end to the other end of said support base, characterized in that said sensing members are inserted in said support base and comprise, near the inlet end of the machine, a first sensing member for controlling the momentary lifting and subsequent lowering of the upper taping head and a second sensing member for subsequently controlling the mutual approach of the conveying units and, near the outlet end of the machine, a third sensing member for controlling the further moving away of said conveying units.

A possible embodiment is shown for better clarity, by way of non-limiting example, in the enclosed drawings, in which:

FIG. 4 shows in enlarged scale the constructional details of a sensing member arranged near the outlet end of said machine;

FIG. 6 shows a diagram of the pneumatic system of said machine.

Figure 1:
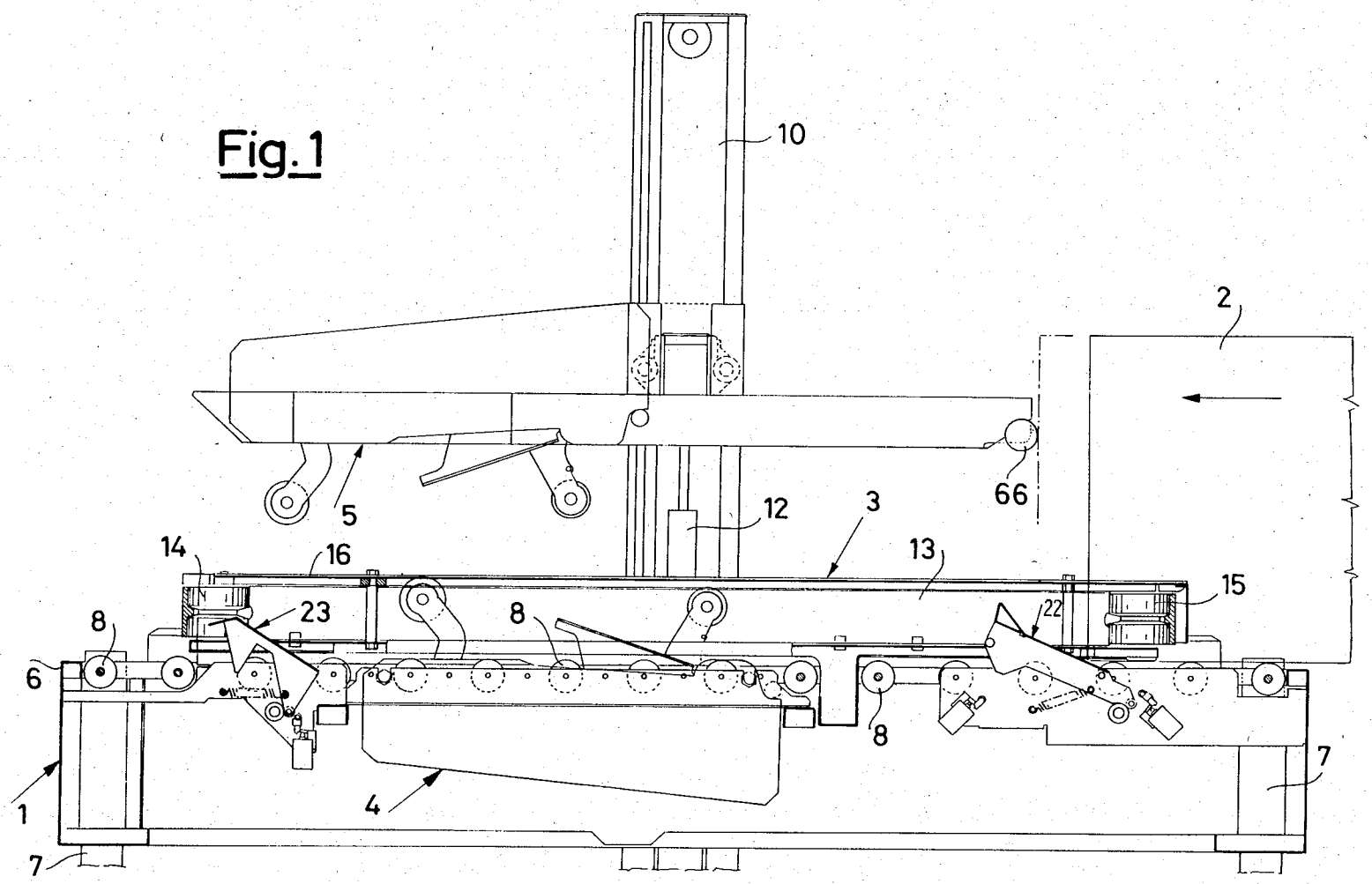
FIG. 1 shows in longitudinal section a self-sizing taping machine according to the present invention.

The self-sizing taping machine shown in the drawings generally comprises a support and advancement base or bed 1 for the cartons to be taped (one of which is designated with 2 in FIGS. 1, 3 and 5), two belt-type conveying units 3 arranged at the two sides of said support base and approachable to each other to engage the carton sides for the rectilinear advancement of the cartons from one end to the other end of said support base (from right to left, looking at FIGS. 1 and 2), a lower taping head 4 for applying an adhesive sealing tape at the bottom wall of the cartons and an upper taping head 5 for applying an adhesive sealing tape at the top of the cartons.

The base 1 is formed by a rectangular frame 6 with legs 7, which rotatably bears a succession of idle transversal rollers 8 defining a support plane for the cartons. At the center of such a succession of rollers there is defined a rectangular space 9 (FIG. 2), in which the lower taping head 4 is inserted and fastened.

From the two sides of the base 1 there extend upwards two box-like columns 10, which slidingly support the two ends of a cross-member 11, on which the upper taping head 5 is mounted. The latter is urged by its own weight towards a lower rest position, shown in FIG. 1, and is provisionally liftable therefrom up to the top of the carton to be taped (FIG. 5) by operating a pair of pneumatic cylinders 12, one for each column 10.

The two conveying units 3 are of the per-se-known type formed by a conveying belt 13 stretched in closed loop between two end pulleys 14 and 15, respectively driving and idle, inside a support and protection structure 16. The driving pulley 14 of each conveying unit 3, and therefore the respective conveying belt 13, is provided with a per-se-known driving system, which leads to a motor assembly generally designated with 17 in FIG. 2. The approaching and moving-away movement of the two conveying units, on the contrary, is controlled by an actuating assembly 69 (FIG. 2), which includes a pneumatic cylinder 18 and causes through articulated arms 19 movement of two sleeves 20, which slide on a stationary cylindric guide 21 and bear the above said support and protection structures 16 of the two conveying units.

Figure 2:
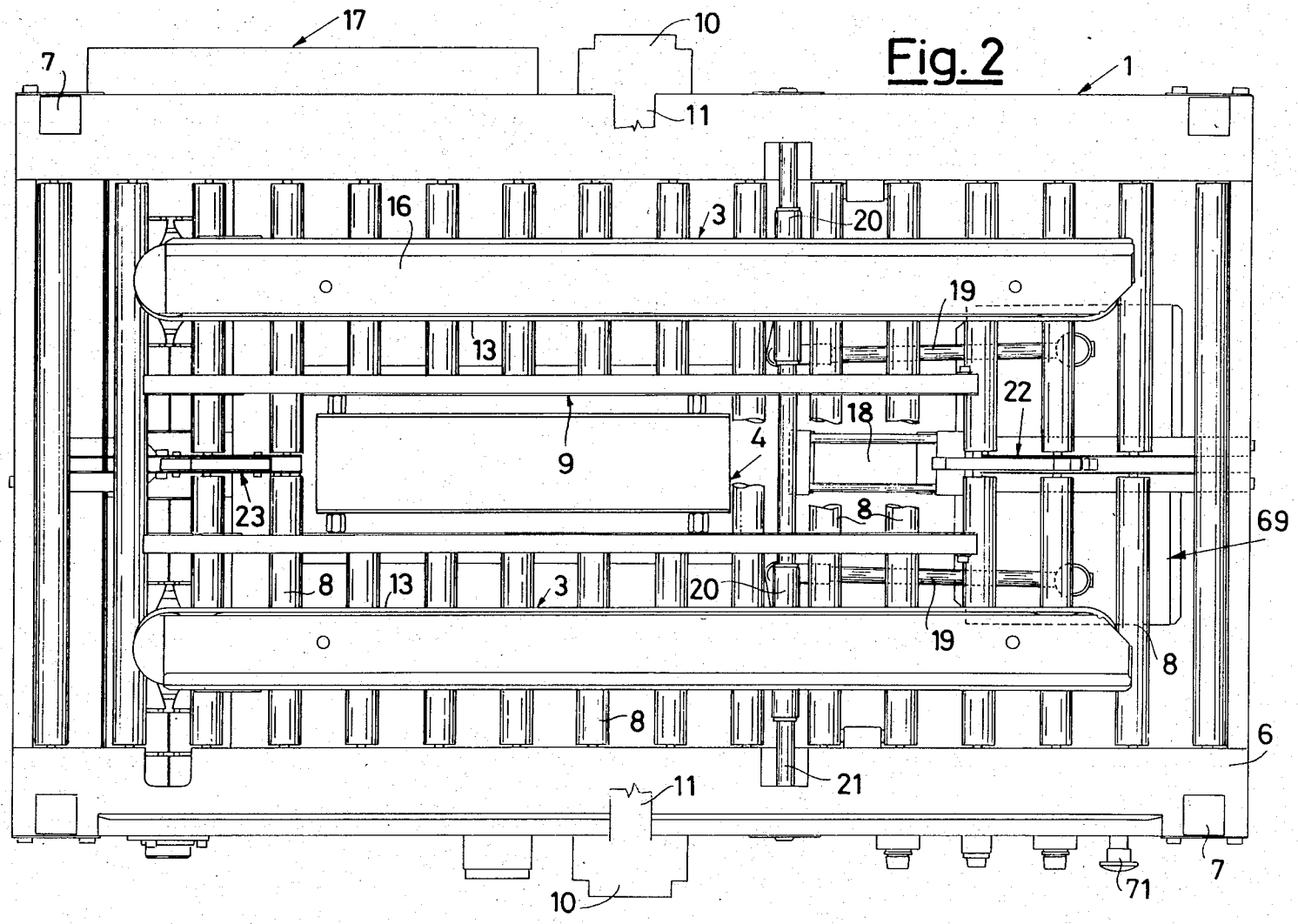
FIG. 2 shows said machine in top plan view with the upper taping head removed for drawing clarity.

As shown in FIGS. 1 and 2, along the support plane defined by the rollers 8 of the base 1 there are positioned two levers 22 and 23 destined for detecting the position of the carton being taped and correspondingly controlling the actuation or the deactuation of the pneumatic cylinders 12 and 18.

Figure 3:
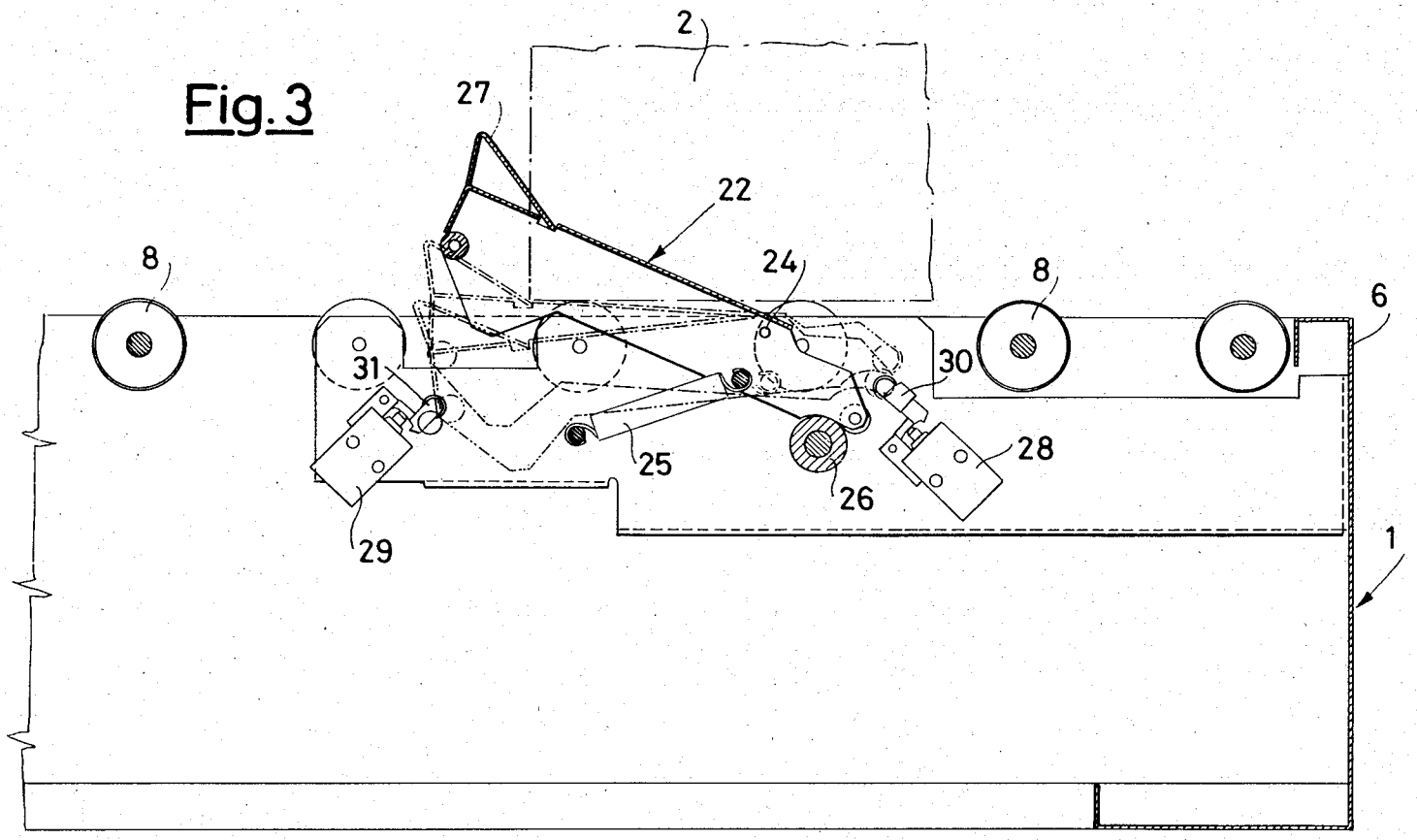
FIG. 3 shows in enlarged scale the constructional details of sensing members arranged near the inlet end of said machine.

It appears from FIG. 3 that the lever 22 is pivoted at 24 on the base 1 and is urged by a spring 25 to put itself in the position shown in solid line, which is defined by its abutment with a fixed pin 26 and is characterized by its projection above the support plane defined by the rollers 8. As a result of the introduction of a carton on the support base 1, however, the above said lever may successively put itslef in the position shown in dash-dot line in FIG. 3, in which only a prong 27 of the lever 22 projects above the rollers 8, and then in the completely withdrawn position which is shown in dash-dot line in FIG. 3. On the position of the lever 22 it is caused to depend the status of two pneumatic valves 28 and 29, whose detecting member 30, 31 includes such an articulated joint as to cause the operation of the respective valve 28, 29 when the lever 22 passes through the second and, respectively, the third one of the three above said positions while going from the first to the third, and not viceversa.

FIG. 4 in its turn shows that the lever 23 is pivoted at 32 and is urged by a spring 33 to put itself in the position shown in solid line, which is defined by its abutment with a fixed pin 34 and is characterized by its projection above the support plane defined by the rollers 8. As a result of the passage of a carton 2, said lever may however put itself in the position shown in dash-dot line in FIG. 4 and then return to the initial position. With the lever 23 cooperates a pneumatic valve 35, which has a detecting member 36, which is articulated in such a way as to cause the operation of the valve 35 when the lever 23 returns to the initial position and not during the going movement of the same.

The machine shown in the drawings finally comprises a pneumatic control circuit, which uses a compressed air supply 61 and includes, inter alia, a bistable distributing valve 62 and a monostable distributing valve 63. The bistable valve 62 is controlled by the above mentioned pneumatic valves 29 and 35 (FIGS. 3 and 4), also through a three-way connecting member 65, and on its position there depends the operation of the pneumatic cylinder 18, in one or the other sense, for the mutual movement of the conveying units 3. The monostable valve 63 is in its turn controlled by the above mentioned pneumatic valve 28 (FIG. 3) through a three-way connecting member 64 and on its position there depends the air supply to the cylinders 12 for the lifting of the upper taping head 5 or (with the valve 28 in the rest position of FIG. 6) the connection of the same cylinders 12 to discharge for their contrary operation under the thrust of the weight of the taping head 5. A flow intercepting valve 67 is interposed between the cylinders 12 and the monostable valve 63 in order to set a minimum value of the air pressure in the discharge duct of the cylinders 12, and therefore for the pressure exerted by the weight of the taping head 5 on the carton arranged below, when the same head, while going down, meets the top of the previously introduced carton. Said intercepting valve is of the kind disclosed in the U.S. Pat. No. 4,060,442 of the present Applicant and is based substantially on the fact that a control member 70 thereof (symbolized as a sphere in FIG. 6) is subjected through a pressure regulator 68 to a predetermined pressure which allows it to block the air flow from the cylinders 12 and towards the discharge of the valve 63 (in the position of FIG. 6) when the pressure of the air ejected by said cylinders 12 goes below said predetermined pressure as a result of the resting of the taping head 5 on the carton top. There is finally arranged a valve 60, whose purposes will be made clear later.

Due to the described structure the taping machine illustrated in the drawings is destined to operate in the following way. At rest, since the distributing valve 62 is in the position of FIG. 6, the compressed air coming from the line 61 obliges the piston of the cylinder 18 to remain in such a position as to keep away the conveying units 3. The rest position of the valve 63, on the other hand, holds the cylinders 12 in the lower position to which corresponds the disposition of the upper taping head 5 (urged by its own weight) in the preselected lower rest position, which is shown in FIG. 1.

Figure 5:
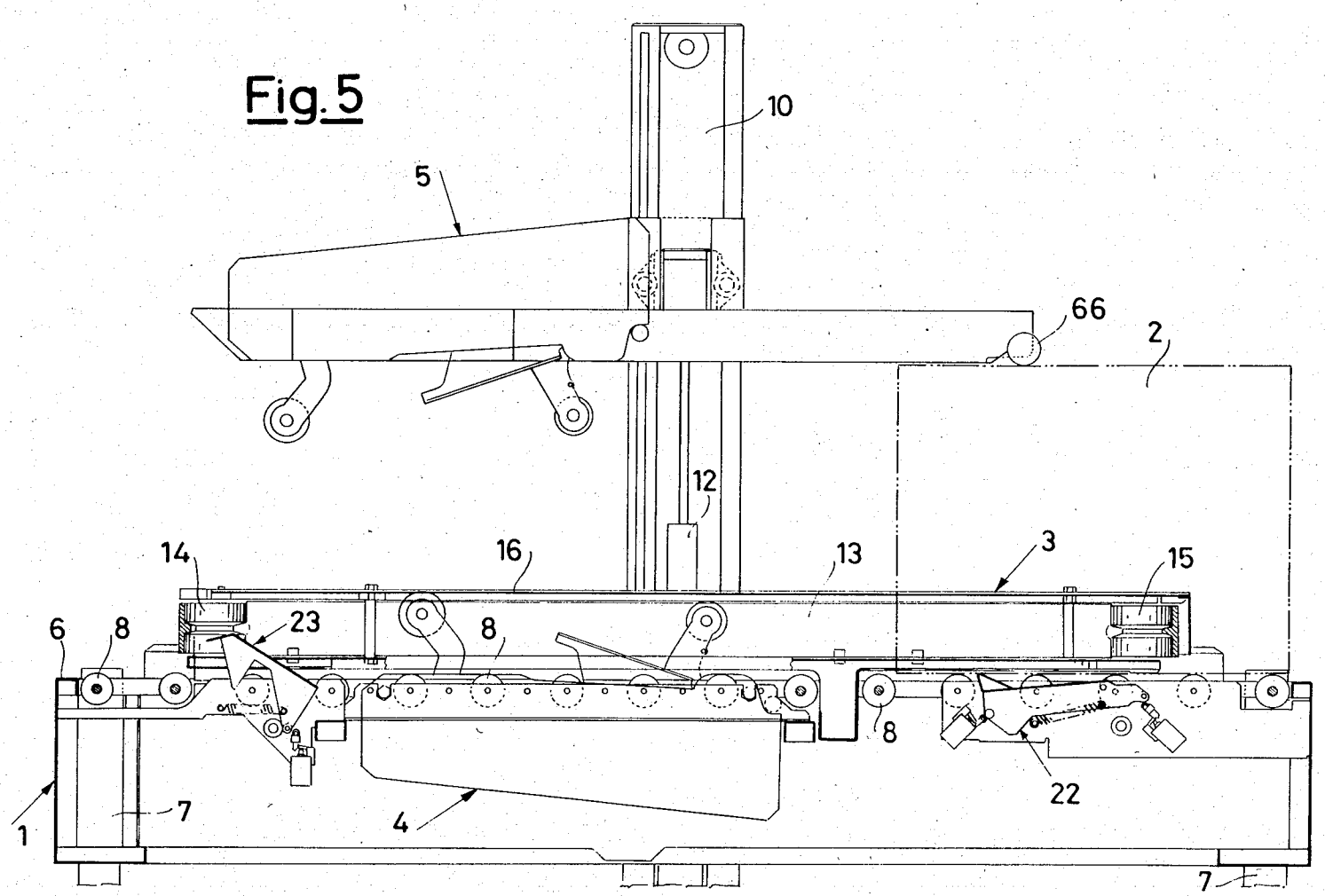
FIG. 5 shows said machine sectioned as in FIG. 1, but in a different operating step on a carton to be taped.

At the time of the introduction of a carton to be taped (already with upper and lower flaps turned in closed position), the same carton is made advancing (FIG. 1) up to cause its front wall to rest against an inlet roller 66 of the upper taping head 5. In such position the carton bottom wall acts on the lever 22 in such a way as to put it in the position shown in dash-dot line in FIG. 3, with consequent switching of the valve 28. Compressed air is consequently fed through the valve 28 and the intercepting valve 67 to the control inlet of the monostable valve 63, which switches and lets air reach the cylinders 12, which cause the lifting of upper taping head 5 up to a height above that of the carton being introduced. Soon afterwards, the carton is subjected to a short manual advancement, which causes it to push down completely the lever 22, putting it in the position shown in dash-dot line in FIG. 3. The monostable valve 63 may thus return to the rest position, connecting the cylinders 12 to discharge through the intercepting valve 67, whose control member 70, by moving from left to right with respect to FIG. 6, blocks the air flow from the cylinders 12 as soon as the pressure in the discharge duct of the cylinders goes below the predetermined value fixed by the regulator 68, as a consequence of the fact that the upper taping head touches the carton top; the resting of the taping head therefore occurs with a suitable predetermined pressure. At the same time, the valve 29 causes the switching of the bistable distributing valve 62, through which pressurized air is then fed to the left chamber of the cylinder 18, while the right chamber of the same cylinder 18 is connected to discharge. The cylinder 18 then causes the mutual approach of the conveying units 3 up to the engagement of the conveying belts 13 with the sides of the carton, which is consequently urged to advance through the sealing area defined by the two taping heads 4 and 5 (FIG. 5).

When the carton goes out of the above said sealing area, the operation and release of the lever 23 finally occur. The return movement of the lever 23 causes the momentary switching of the valve 35 and therefore the delivery of a control pulse, which causes through the connecting member 65 the return of the distributing valve 62 to the rest position of FIG. 6. Compressed air is then fed again to the right chamber of the cylinder 18, which causes the mutual moving away, that is the "reopening", of the conveying units 3. The upper taping head 5, no longer retained by the underlying carton, in its turn goes down again by gravity to the initial position of minimum height.

Faults of the carton or other drawbacks may sometimes cause the jamming of the carton inside the sealing area, when, for what previously said, the valve 28 and 35 are in the rest position of FIG. 6, while the valve 29 and 62 are in switched position and, consequently, the upper taping head 5 is resting on the carton top and the conveying units 3 are engaged with the carton sides, that is, as commonly said, the machine is in condition of "closure" of the sealing area.

Should this occur, a prompt remedy is however already provided, represented by a push-button 71 (FIG. 2) acting on the valve 60 of FIG. 6. By depressing said push-button, in fact, it is possible to cause the switching of the valve 60, which causes through the connecting members 64 and 65 the switching of the distributing valves 63 and 62 for the respective operation of the cylinders 12 and 18 in the sense of lifting of the upper taping head 5 and of moving away of the conveying units 3. The complete "reopening" of the sealing area for the free, easy and sure access of the operator to the carton is thus obtained.

I claim:

1. Self-sizing taping machine for cartons, comprising a support and advancement base for the cartons, a pair of conveying units with driven belts extending along opposite sides of said base and approachable to each other for a conveying engagement with the carton sides, an upper taping head superimposed to said base in vertically movable way for the introduction of the cartons to be taped and sensing members able to control the movement of said upper taping head and of said conveying units according to the position of the cartons along an advancement path from one end to the other end of said support base, characterized in that said sensing members are inserted in said support base and comprise, near the inlet end of the machine, a first sensing member for controlling the momentary lifting and the subsequent lowering of the upper taping head and a second sensing member for subsequent controlling the mutual approach of the conveying units and, near the outlet end of the machine, a third sensing member for controlling the further moving away of the conveying units, said first and second sensing members including a first and second valve means, with which a first lever cooperates, which is resiliently urged to a rest position, in which said first lever projects above the carton support plane, but is able to attain, upon engagement with a carton bottom wall, first and second working positions for the corresponding operation of said first and second valve means.

2. Taping machine according to claim 1, characterized in that said third sensing member includes a third valve means, with which a second lever cooperates, which is resiliently urged to a rest position, in which said second lever projects above the carton support plane, but is able to carry out, upon engagement with the carton bottom wall, a going and return movement to and from a working position for the corresponding operation of said third valve means.

3. Taping machine according to claim 2, characterized in that said valve means are part of a pneumatic control circuit further including a monostable distributing valve and a bistable distributing valve, said monostable valve controlling lifting means for lifting the upper taping head from a position of minimum height and being controlled in its turn by said first valve means, and said bistable valve controlling the approaching and moving-away movements of said conveying units and being controlled in its turn by said second and third valve means, respectively for the one and the other of said movements.

* * * * *